United States Patent [19]

Haftmann et al.

[11] Patent Number: 4,964,743

[45] Date of Patent: Oct. 23, 1990

[54] RECEPTACLE FOR A HOLDER FOR A RIBBON FOR USE IN TYPEWRITERS OR SIMILAR MACHINES

[75] Inventors: Johannes Haftmann, Schwabach; Werner Haczek, Furth, both of Fed. Rep. of Germany

[73] Assignee: TA Triumph-Adler Aktiengesellschaft, Nuremberg, Fed. Rep. of Germany

[21] Appl. No.: 280,485

[22] Filed: Dec. 6, 1988

[30] Foreign Application Priority Data

Dec. 7, 1987 [DE] Fed. Rep. of Germany ..... 3741360

[51] Int. Cl.[5] ..... B41J 32/00; B41J 33/24; B41J 33/52

[52] U.S. Cl. ..... 400/208.1; 400/196; 400/207; 400/228; 400/234

[58] Field of Search ..... 400/194, 195, 196, 196.1, 400/207, 208, 208.1, 228, 234

[56] References Cited

U.S. PATENT DOCUMENTS

| | | | |
|---|---|---|---|
| 3,976,183 | 8/1976 | Fleischmann et al. | 400/228 X |
| 3,977,511 | 8/1976 | Hengelhaupt | 400/207 X |
| 4,213,715 | 7/1980 | Haftmann et al. | 400/196.1 |
| 4,264,223 | 4/1981 | Bemis et al. | 400/208 |
| 4,265,552 | 5/1981 | Bemis et al. | 400/208 X |
| 4,299,504 | 11/1981 | Benz et al. | 400/208 |
| 4,359,288 | 11/1982 | Bullock | 400/208 |
| 4,815,875 | 3/1989 | Richardson et al. | 400/208.1 |
| 4,854,755 | 8/1989 | Lange et al. | 400/208 |
| 4,861,177 | 8/1989 | Heins et al. | 400/208 |

FOREIGN PATENT DOCUMENTS

| | | | |
|---|---|---|---|
| 0234304 | 9/1987 | European Pat. Off. | 400/208 |
| 2405099 | 12/1980 | Fed. Rep. of Germany . | |
| 2084958 | 4/1982 | United Kingdom | 400/208 |

*Primary Examiner*—Edgar S. Burr
*Assistant Examiner*—John S. Hilten
*Attorney, Agent, or Firm*—Browdy and Neimark

[57] ABSTRACT

A receptacle for a holder of a ribbon of a typewriter or similar machine. The holder has a base plate on which laterally pivotable retaining elements are disposed. The retaining elements support drive, braking and tensioning elements for the ribbon. If the retaining elements are pivoted away, a holder, e.g. in the shape of a ribbon cassette, can be inserted into the device. When the retaining elements have again been pivoted back, they surround the holder of the ribbon in the form of a shell. The drive, braking and tensioning elements then automatically take up their functionally correct positions. The device has the advantage that only the holder with the used-up ribboon need be discarded, while the drive, braking and tensioning elements remain in the device and thus can be repeatedly used. Manufacture of the holder with the ribbon is made considerably more economical this way and the value of the material to be discarded is reduced.

7 Claims, 2 Drawing Sheets

RECEPTACLE FOR A HOLDER FOR A RIBBON FOR USE IN TYPEWRITERS OR SIMILAR MACHINES

FIELD OF THE INVENTION

The invention relates to a receptacle for a holder for a ribbon for use in typewriters or similar machines.

BACKGROUND OF THE INVENTION

Customarily such holders are in the form of ribbon cassettes. In the case where the ribbon cassettes contain a ribbon which is only used once, they are normally discarded. Simultaneously the ribbon guidance, tensioning and drive elements contained in the ribbon cassette are also discarded. This means that on the one hand a considerable effort is expended in the manufacture of ribbon cassettes in connection with their manufacture and installation and, on the other, many parts must be discarded. This is uneconomical and does not correspond to the requirements for environmental conservation.

It is known from German Pat. No. 24 05 099 to provide a holder which makes the insertion of the ribbon with its spools into a receptacle of the machine easier. Manipulation of this holder requires a certain degree of skill which must first be acquired by the operator. Furthermore, the holder consists of several parts and is itself a comparatively complicated element.

SUMMARY OF THE INVENTION

It is an object of the invention to provide a receptacle for a holder of a ribbon which has been designed in such a way that only the holder and not the drive, braking and tensioning elements are discarded when the ribbon is used up. Suitable for this is a device in which the receptacle is in the form of a base plate on which are disposed pivotable retaining elements which surround the holder of the ribbon in a shell-like manner in the operating position and which have drive, braking and tensioning elements for the ribbon.

Because the receptacle is not a permanent part of the machine or of the printer, it can be removed from the machine for the purpose of inserting a fresh holder with a ribbon. It also can be repeatedly used, because it itself is not subject to wear. If properly used it can be imagined that the life of the receptacle will equal the life of the machine. After the ribbon is used up, the holder alone is discarded, while the guidance and tensioning elements etc. remain a part of the receptacle.

In accordance with the present invention, an already proven sprocket wheel is used as drive element which can brought into interaction with the take-up spool of the ribbon. The take-up spool of the holder is pressed against this sprocket wheel so that the ribbon can be moved. As usual in ribbon cassettes, coupling of the sprocket wheel with the drive provided on the machine, e.g. a motor-driven clutch shaft, takes place when the receptacle is inserted into the typewriter or printer. In accordance with the present invention, it is particularly advantageous that only a single spring performs two different functions the braking element is a spring arm which brakingly acts on the core of the supply spool of the ribbon and simultaneously presses the take-up spool against the sprocket wheel. In accordance with the present invention, a roller seated on a resilient arm, is used as a ribbon tensioning element which simultaneously serves to guide the ribbon. The tensioning element is in the form of a roller, rotatably disposed on a spring arm, around which the ribbon can be guided and put under tension.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

The invention of the present application will now be described in more detail with reference to the preferred embodiments of the device, given only by way of example, and with reference to the accompanying drawings, in which.

DETAILED DESCRIPTION OF THE PREFERRED EMBODIMENT

Figure 1:
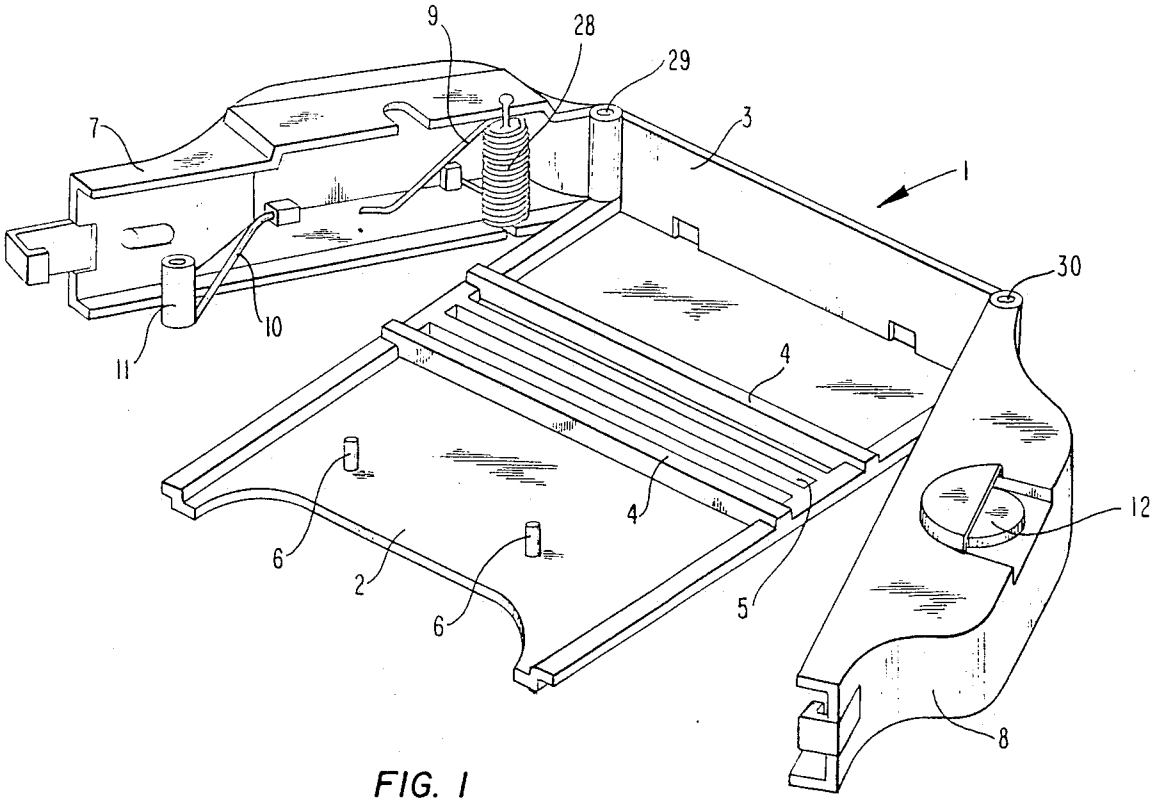
FIG. 1 is a schematic view of the receptacle and the holder, both in the opened position.

The receptacle is generally designated by reference numeral 1. It comprises a base plate 2, attached to a rear wall 3. Raised guide bars 4, between which a slot 5 is disposed, extend parallel to this wall 3. Additionally, pins 6, suitable as positioning elements for the holder 15 to be described later, are formed on the base plate 2.

Pivotable retaining elements 7 and 8 are disposed on pivots 29, 30 which are located on each side of the base plate 2. A spring 28, having a free arm 9, is disposed on the retaining element 7. Furthermore a wire spring 10 is provided, having a freely turnable roller 11 on its free end.

A small wheel 12 is disposed on the other pivotable retaining element 8 and a sprocket wheel 14 is disposed on a shaft 13 of wheel 12. The small wheel 12 is used to put tension on the ribbon. For this purpose it can be equipped with a ratchet known per se which permits turning only in one direction.

Figure 2:
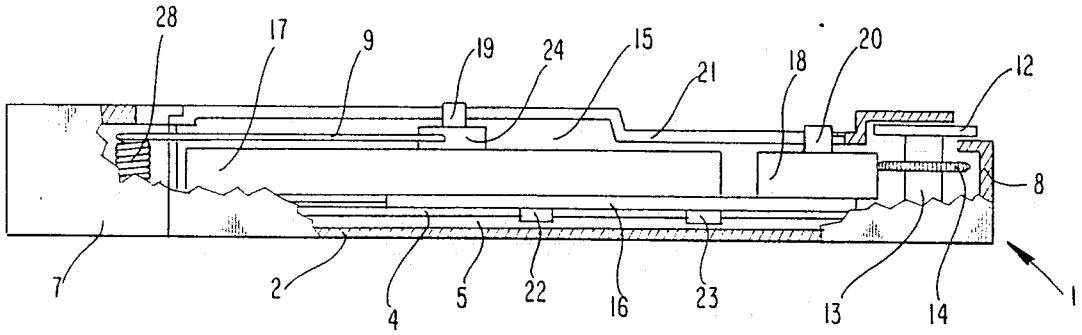
FIG. 2 is a section through the receptacle in the closed position with the holder for the ribbon inserted.

In the exemplary embodiment shown in the drawing the holder 15 is in the form of a cassette in which the supply spool 17 and the take-up spool 18 are rotatably seated on a slider 16. The support pins 19 and 20 for the spools 17 and 18 are upwardly extended through a slit 21 of the holder 15. Furthermore, downwardly extending sliding elements 22 and 23 are disposed on the slider 16 which come to rest in the slot 5 of the base plate 2 of the receptacle 1. In this manner the slider 16 rests on top of the guide bars 4 and is guided on the one side by means of the sliding elements 22 and 23 in the slot 5 and with the support pins 19 and 20 in the slit 21 of the holder 15. Furthermore, it is apparent from FIG. 2 how the arm 9 of the spring 8 presses against the core 24 of the supply spool 17. Two functions are assigned to the spring arm 9. For one, it brakes the rotational movement of the supply spool 17 by being pressed against the spool core 24. For another, the arm 9 of the spring 28 pushes the slider 16 with the two spools 17 and 18 in the direction towards the sprocket wheel 14 in such a manner that the latter abuts against the take-up spool 18.

Operation of the device is most simple and no great skill is required to exchange a used-up ribbon for a new one. First, the receptacle I in the closed position, together with the holder 15, is removed from the typewriter. Then the retaining elements 7 and 8 are laterally pivoted away so that the holder 15 can be upwardly removed from the base plate 2. A fresh holder 15 then can be inserted. The two pins 6 of the base plate 2 are used to correctly position the holder 15. Then the two retaining elements 7 and 8 are pivoted inwards again so that they surround the outer parts of the holder 15, which is in the form of a cassette, like a shell. During this process the spring arm 9 automatically abuts against the core 24 of the supply spool 17. This in turn assures that the take-up spool 18 abuts against the sprocket wheel 14. The roller 11 of the spring 10 lies against the ribbon from the outside in such a way that the ribbon partially surrounds this roller 11. Because of this the ribbon 17 is put under tension, which is required in order to guide it correctly through the place where printing takes place.

Because the drive (14), braking (9) and tensioning elements (10, 11) for the ribbon remain in the receptacle, the holder for the ribbon can be manufactured considerably more cheaply and simply. This makes the entire device more attractive to the customer, because the purchase of a new ribbon holder is considerably less expensive. The entire device 1 with the holder 15 inserted can be handled like a ribbon cassette of the customary type and inserted into and removed from the typewriter in the same way. If the receptacle 1 is sufficiently sturdy and is correctly handled, it can be repeatedly used. Of course, it is also possible to offer the receptacle separately, so that it can be purchased at a later time in case it has been damaged and can no longer be used correctly.

The spring 28 and the small wheel 12 with the sprocket wheel 14 can be inserted into the retaining elements 7 and 8 by simply plugging them in. The same is true for the spring 10 with the roller 11.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A receptacle for a holder of a ribbon for typewriters or similar machines, comprising:

a base plate; and pivotable retaining elements disposed on said base plate for surrounding the holder of the ribbon in a shell-like manner in an operating position, said retaining elements having a drive element, a braking element and tensioning elements for the ribbon.

2. A device in accordance with claim 1, wherein the drive element comprises a sprocket wheel which can be brought into interaction with a take-up spool for the ribbon.

3. A device in accordance with claim 1, having a braking element comprising a spring arm which brakingly acts on a core of a supply spool of the ribbon and simultaneously presses a take-up spool against a sprocket wheel.

4. A device in accordance with claim 1, wherein the tensioning elements comprise a roller, rotatably disposed on a spring arm, around which the ribbon can be guided and put under tension.

5. A device in accordance with claim 1, wherein the receptacle further comprises a rear wall disposed on a rear side of said base plate perpendicular with respect thereto, and the pivotable retaining elements are pivoted off respective ends of said rear wall perpendicular to said base plate.

6. A device in accordance with claim 2, wherein the drive element further comprises a shaft about which the sprocket wheel is disposed, and a wheel attached to said shaft and exposed to the outside of the retaining element for allowing tensioning of the ribbon.

7. A device in accordance with claim 1, wherein the retaining elements are pivotable between the operating position in which the retaining element surrounds the holder of the ribbon in a shell-like manner an open position which allows the holder to be inserted into the receptacle.

* * * * *